US005334027A

United States Patent [19]

Wherlock

[11] Patent Number: 5,334,027

[45] Date of Patent: Aug. 2, 1994

[54] BIG GAME FISH TRAINING AND EXERCISE DEVICE AND METHOD

[76] Inventor: Terry Wherlock, 3641 Rebel Cir., Huntington Beach, Calif. 92649-2513

[21] Appl. No.: 661,434

[22] Filed: Feb. 25, 1991

[51] Int. Cl.[5] ..... A63B 69/00; G09B 25/00

[52] U.S. Cl. ..... 434/247; 434/392; 43/4

[58] Field of Search ..... 434/392, 247, 258, 61; 340/323 R; 364/410, 518; 482/6, 8, 5, 51, 63, 901, 902; 73/379.06; 43/4

[56] References Cited

U.S. PATENT DOCUMENTS

| | | | |
|---|---|---|---|
| 3,903,613 | 9/1975 | Bisberg | 434/61 |
| 4,408,183 | 10/1983 | Wills | 340/323 R |
| 4,408,613 | 10/1983 | Relyea | 482/5 X |
| 4,637,603 | 1/1987 | Fry et al. | 272/1 R |
| 4,752,878 | 6/1988 | Sigurdsson et al. | 43/4 X |
| 4,869,497 | 9/1989 | Stewart et al. | 482/901 X |

FOREIGN PATENT DOCUMENTS

| | | | |
|---|---|---|---|
| 0079892 | 3/1990 | Japan | 434/392 |
| 0007978 | 1/1991 | Japan | 434/392 |
| 0007979 | 1/1991 | Japan | 434/392 |
| 0007980 | 1/1991 | Japan | 434/392 |
| 0007981 | 1/1991 | Japan | 434/392 |

*Primary Examiner*—Richard J. Apley
*Assistant Examiner*—John P. Leubecker
*Attorney, Agent, or Firm*—Wagner & Middlebrook

[57] ABSTRACT

A simulator that imitates the fighting action of a hooked fish such that it takes line at varying speeds and torques, or at a fixed speed or torque. The simulator can be used for training, exercising of the angler or testing of components of the tackle such as the rod, reel, rollers and line. Control of the simulator can be by a personal computer, tape or disc system, manual, electronic or mechanical means or a combination of same. Optional video, analog and/or digital displays can enhance the realism of the simulator.

10 Claims, 2 Drawing Sheets

BIG GAME FISH TRAINING AND EXERCISE DEVICE AND METHOD

BACKGROUND OF THE INVENTION

Anglers and especially big game fishermen, spend thousands of dollars in pursuit of record fish or to participate in tournaments. In a typical marlin tournament, transportation, accommodation, boat and entry fees can total $2,000–$7,000 or more. Because few marlin are caught, the angler is generally not well prepared physically or by training to provide the most favorable chance of success when a marlin is hooked up.

Rarely are record fish caught and most fish are lost. A well trained angler could increase the odds of success and pre-tested tackle would further enhance the position. Research has shown that it may take up to ten angler days, each costing up to $1,000 to actually catch a marlin. Other statistics show that at least two fish are lost for each marlin caught—more if the angler has insufficient experience.

No form of training device exists that can simulate the fish action. Anglers are, therefore, ill prepared both physically and by training to maximize their chance of success. Typically in fighting a marlin or other large fish, the angler is called upon to use muscle combinations and stresses that are not experienced in everyday use or conditioned well by normal exercise machines or routines. Anglers lose fish due to cramp or insufficient muscle development and coordination, failing to quickly boat the fish before tackle or the angler fails. Tackle also fails due to overload or abrasion or because it is not correctly set for the appropriate fighting conditions.

Similar problems, but on a different scale, exist for anglers and tackle manufacturers fishing or manufacturing equipment for smaller specie and using lighter tackle. Examples of such fish are: bass, walleye, salmon, trout and catfish. Although the maximum energy demand to fight a large fish may be more, the stress and skill required is similar. As an example, a 20 lb. fish on 2 lb. line requires similar skill to that required to catch a 200 lb. fish on 20 lb. line.

BRIEF DESCRIPTION OF THE INVENTION

This invention relates to a simulator which, operating in conjunction with a fishing rod and reel enables an individual to practice the skills necessary to reel in a fish, particularly a large fish.

The outboard end of the fishing line is connected to a take-up reel which is driven by a motor/clutch arrangement. The motor/clutch is controlled by a motor controller which either includes a programming capability or is connected to a programming device such as a programmed computer (PC) or a tape or video recorder-player. When a personal computer is used a program may allow the user to select the type or weight of fish to be simulated or this can be determined by a random selection so the user is faced with the same uncertainty as experienced when fishing.

The simulator may include, optionally, monitors to provide instantaneous read out of such sensed conditions as line tension, line taken out and recovered, elapsed time, speed of line pull out, etc. An additional optional monitor can display an actual or simulated display of the hook up of the fish and the subsequent fight to get the fish to the boat.

The program is designed to provide speed and torque signals to the motor/clutch which simulate the forces on a fishing line during hook-up and subsequent fight with a large fish. While the system has been designed to simulate fishing for game fish which may weigh hundreds of pounds, it is also suitable for simulating a fight with a much smaller fish such as a walleye pike which may weigh 10–20 pounds and which can also make a substantial fight where the angler is using light line.

BRIEF DESCRIPTION OF THE DRAWING

This invention may be more clearly understood from the following detailed description and by reference to the drawing in which.

DETAILED DESCRIPTION OF THE INVENTION

Figure 1:
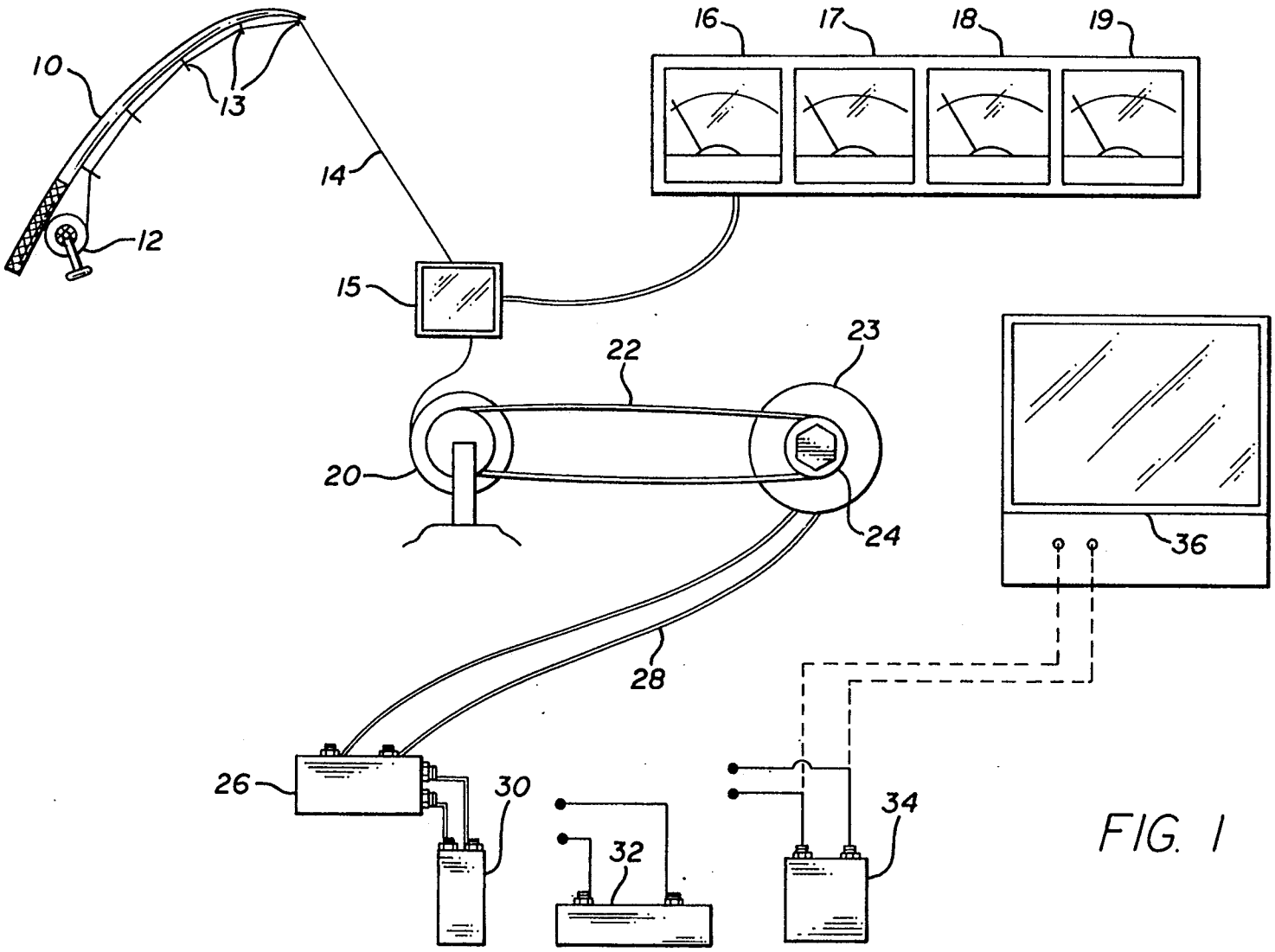
FIG. 1 is a schematic drawing of a fishing simulator and training device according to my invention.

Referring now to FIG. 1, a fishing rod is shown at numeral 10 having attached thereto a reel 12 carrying a substantial length of fishing line 14. The rod 10 and reel 12 are operated by a trainee or operator, not shown. Line 14 passes through a series of guides 13 before being fed through a line condition sensor 15 which may sense one or more characteristics of the line. These are read out on a plurality of gauges including line tension 16, line length taken out or recovered 17, elapsed time 18, speed of line pull-out 19, etc., all of which are visible to the trainee or operator.

One of the guides 13 may incorporate a transducer to allow the fishing reel clutch drag to be set. Because drag effect will vary as the reel diameter is changed, the use of a guide with transducer will allow the user to monitor and adjust clutch drag as required. The guide with transducer may be removable so as to allow this to be affixed to an alternative rod, reel and line combination.

The line 14 is then supplied to a take-up reel 20 which pulls on line 14 with varying amounts of torque and speed as described below. Reel 20 may be connected through a common shaft to a motor 23 and/or an optional clutch assembly 24 or it may be connected through a belt 22 as shown. A motor controller 26 which is shown connected via wires 28 to the A.C. or D.C. drive motor 23, is capable of supplying input signals causing the motor 23 to vary in its torque and speed output. Optionally, it may be desired in some cases to vary the output of clutch 24. The clutch 24 may be a magnetic particle or friction clutch. Adjusting the clutch will produce a variation in speed and/or torque.

Motor controller 26 may contain its own programming means such as an internal tape transport or it may receive pre-recorded signals representing speed vs. time and torque vs. time from a data storage device such as a personal computer 32 or an external tape recorder 30. Alternatively, motor controller 26 may receive programmed input signals from a disk drive device 34, or other source of preprogrammed torque vs. time and speed vs. time signals. The programs may, of course, be varied to provide different speed and torque vs. time patterns for successive hook ups, or to simulate different types of fish. Any of the described signal sources may optionally be connected to a CRT monitor 36 which can simultaneously display a simulated catch or reproduction of an actual fish catching operation which is coordinated with and visible to the trainee or operator during the time the programmed fish catching exercise is proceeding.

Figure 2:
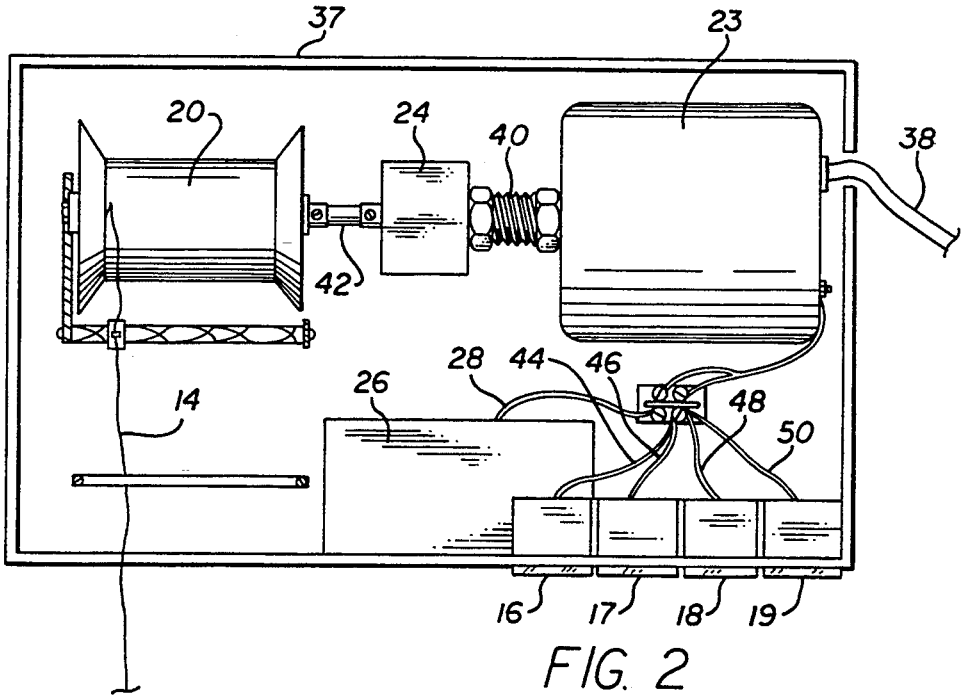
FIG. 2 is a plan view of a physical assembly incorporating and housing most of the combination of FIG. 1.

FIG. 2 is a plan view of a physical assembly incorporating in a housing 37 most of the combination of FIG. 1. Motor 23 is supplied with power from a power source through a cord 38 and drives a clutch 24 (optional) through a shaft 40. Motor 23 may preferably drive the take-up reel 20 directly. In this example, the clutch 24 is connected directly to the take-up reel 20 through a shaft extension 42. Take-up reel 20 should preferably include a level wind mechanism 21. Fishing line 14 is fastened to a leader attached to the take-up reel or the line 14 may be fastened directly to take-up reel 20. The instruments 16, 17, 18 and 19 are connected to motor 23 through wires 44, 46, 48 and 50, respectively. The motor controller 26 is connected through wires 28 to motor 23. If a clutch 24 is included, its control may also be housed in the motor controller 26 housing with separate wires 25 connected to clutch 24.

Figure 3:
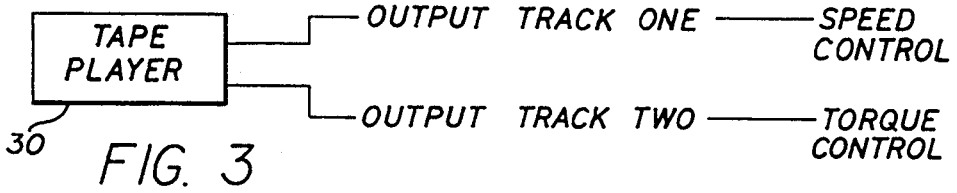
FIG. 3 is a schematic drawing of a tape player and connections which can be used with the system of FIGS. 1 and 2.

FIG. 3 is a schematic drawing of a tape player-recorder such as recorder 30 indicating that a double track tape may be used with a pre-recorded speed signal on one track and a pre-recorded torque signal on the other track, such signals being coordinated to effect the desired simulation.

Figure 4:
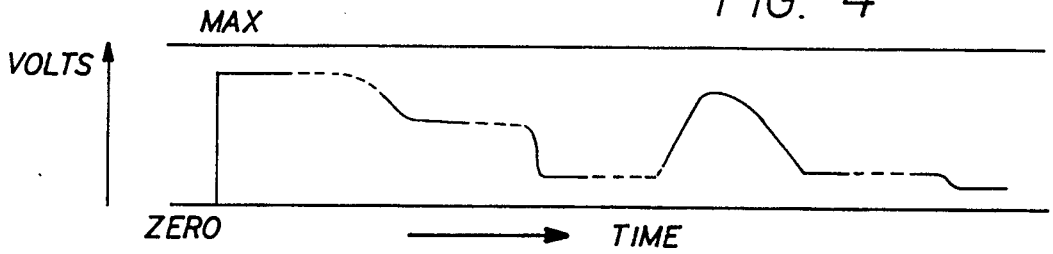
FIG. 4 is a graph showing a typical programmed characteristic of speed control output vs. time of the tape player of FIG. 3.

FIG. 4 is a graph showing the manner in which a voltage signal representing speed can be varied with time along the length of the tape. The particular pattern shown may be viewed as showing an abrupt increase in voltage following the initial strike by the fish representing an initial high speed run out, lower voltage subsequently representing slowing, further slowing as the fish slows and perhaps turns. A subsequent peak may represent a dive to attempt to dislodge the hook with reduced speed as the fish reverses and climbs up again.

Figure 5:
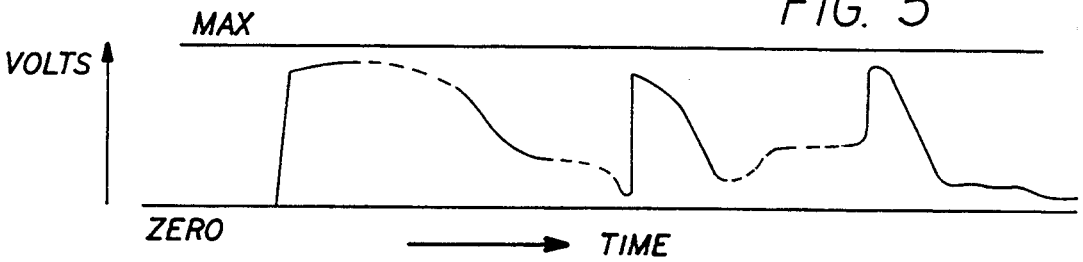
FIG. 5 is a graph showing a typical programmed characteristic of torque output vs. time of the tape player of FIG. 3.

FIG. 5 is a graph showing a programmed characteristic of torque output vs. time. This graph is coordinated with the speed graph discussed above. The maximum torque reading may occur shortly after the strike and torque and speed both continue high during the initial run out. Another torque peak occurs during a dive and may also occur when the fish breaks out of the water and dances on its tail to try to dislodge the hook.

In addition to its benefits as a training device for the angler, the simulator described above assists the angler in developing the muscle tone necessary to land large game fish. It is a very effective exercise machine and can provide a substantial work out for anyone. It is also capable of providing a good testing environment for tackle.

The above described embodiments of the present invention are merely descriptive of its principles and are not to be considered limiting. The scope of the present invention instead shall be determined from the scope of the following claims including their equivalents.

What is claimed is:

1. A simulator for simulating the action of a fighting fish which is hooked up at the end of a fishing line including a fishing rod, a reel attached to the rod and to one end of a length of the fishing line comprising:

a take-up reel connected to the second end of the fishing line;

a motor operatively connected to said take-up reel;

a motor controller connected to said motor capable of independently varying the speed and torque of said motor to vary the speed and tension on the line exerted by said take-up reel;

a recorder having a recording medium with prerecorded signals corresponding respectively to variable speed and tension on the fishing;

said recorder operatively connected to said motor controller to simultaneously and independently control the torque and speed of said motor;

transducer means coupled to said fishing line for measuring the tension on said line; and means for displaying line tension for the user during operation while the user may feel line tension and observe rod bending.

2. The simulator as claimed in claim 1 wherein a clutch is connected between said motor and said take-up reel;

wherein said clutch is electrically controlled by said controller to vary the torque from said motor as applied to said take-up reel.

3. A simulator as claimed in claim 1 wherein a monitor displaying a fishing sequence including a fish hookup and fight is provided to enable an individual operating the fishing rod and reel to observe a hook up and fight; and means for coordinating the monitor display with the variations in speed and torque of said motor as functions of elapsed time as controlled by said motor controller.

4. A simulator as claimed in claim 1 including a computer programmed to provide variable signals representing speed and torque as functions of time.

5. A simulator that simulates the action of fighting fishing on the end of a fishing line including a fishing rod, a reel attached to said rod, a length of fishing line carried on said reel with one end secured thereto, comprising:

a take-up reel connected to the opposite end of said fishing line from the reel;

a motor operatively connectged to said take-up reel;

a motor controller connected to said motor;

programmable means connected to said motor controller for varying the torque and speed of said take-up reel;

wherein said programmable means comprises a recorder for storing variable signals representing speed and torque as functions of time means for measuring tension of said line; and means for displaying line tension for the user while the user may feel line tension and observe rod bending.

6. A simulator as claimed in claim 5 wherein the reel includes a clutch drag settable by the user; and said tension measuring means includes line condition sensing means coupled to said line detecting instantaneous tension of the fishing line as affected by the user drag setting and the speed and torque of said take-up reel.

7. A method of simulating the steps of catching and landing fish including the steps of:

a) recording signals representing variations in line tension and speed of a sequence representing the hooking and landing of a fish;

b) providing the individual with a rod and a reel with fishing line on said reel with an outboard end of the line available for connection to a source of fish simulating load;

c) connecting the outboard end of said fishing line to a variable speed, variable torque motor means;

d) providing a programmed control of the speed and torque of said motor means to vary the speed and tension on said fishing line with elapsed time to simulate the action of a hooked fish;

e) monitoring the line tension; and f) means for displaying line tension for the user while the user may feel line tension and observe rod bending.

8. A method as claimed in claim 7 wherein the step of providing a programmed control of the speed and torque of said motor means further includes the step of programming several torque and speed combinations to change the speed and torque characteristics on said line for alternative simulated hook-ups.

9. A method as claimed in claim 8 including a providing a monitor capable of displaying a simulated hook-up and fight coordinated with said programmed speed and torque characteristics.

10. A method of simulating the step of an angler by simulating a strike and subsequent fight with a game fish including the steps of:

a) providing the angler with a rod, a reel with controllable drag and a length of line on said reel;

b) providing means for effecting a variable pull on the outboard end of said line including a take-up reel;

c) pulling sharply on said line with a high torque on said take-up reel followed by a high speed run outward to simulate an initial strike and run out by a fish;

d) subsequently and independently reducing the torque and speed of said line to simulate the end of said run out;

e) further varying the torque and speed of pull on said line to simulate line loads during the fight; and for displaying line tension for the angler during the simulation while the user may feel line tension and observe rod bending.

* * * * *